US007344327B2

(12) United States Patent
Gueret

(10) Patent No.: US 7,344,327 B2
(45) Date of Patent: Mar. 18, 2008

(54) APPLICATOR FOR COSMETIC PRODUCTS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 337 days.

(21) Appl. No.: 10/910,329

(22) Filed: Aug. 4, 2004

(65) Prior Publication Data

US 2005/0031401 A1 Feb. 10, 2005

Related U.S. Application Data

(60) Provisional application No. 60/499,354, filed on Sep. 3, 2003.

(30) Foreign Application Priority Data

Aug. 4, 2003 (FR) ..... 03 09604

(51) Int. Cl.
*A46B 11/00* (2006.01)

(52) U.S. Cl. ..... 401/129; 401/126

(58) Field of Classification Search ..... 401/121–130, 401/6; 15/172, 144.1
See application file for complete search history.

(56) References Cited

U.S. PATENT DOCUMENTS

| | | | | |
|---|---|---|---|---|
| 2,173,959 A | | 2/1939 | Britt | |
| 3,763,870 A | | 10/1973 | Montgomery et al. | |
| 4,428,388 A | | 1/1984 | Cassai | |
| 4,712,266 A | | 12/1987 | Yamaki | |
| 4,784,505 A | * | 11/1988 | Dahm | 401/122 |
| 5,328,282 A | * | 7/1994 | Charrier et al. | 401/4 |
| 5,575,579 A | | 11/1996 | Joulia | |
| 5,961,238 A | * | 10/1999 | de Bruin et al. | 401/122 |
| 6,033,143 A | | 3/2000 | Gueret | |
| 6,227,737 B1 | | 5/2001 | Lightfoot | |
| 6,341,912 B1 | | 1/2002 | Gueret | |
| 6,546,588 B1 | * | 4/2003 | Black | 15/244.1 |
| 6,695,513 B1 | * | 2/2004 | Malek | 401/129 |
| 6,957,958 B2 | * | 10/2005 | Rowe et al. | 433/89 |
| 7,086,116 B2 | | 8/2006 | Broecker et al. | |

FOREIGN PATENT DOCUMENTS

| | | |
|---|---|---|
| CN | 1184619 A | 6/1998 |
| FR | 2 705 876 | 12/1994 |
| FR | 2 722 380 | 1/1996 |
| FR | 2 722 381 | 1/1996 |
| JP | A-62-174263 | 7/1987 |
| JP | U-3-62510 | 6/1991 |
| JP | A-9-187421 | 7/1997 |
| JP | A-2001-017234 | 1/2001 |
| JP | A-2002-000347 | 1/2002 |

* cited by examiner

*Primary Examiner*—David J. Walczak
(74) *Attorney, Agent, or Firm*—Oliff & Berridge, PLC

(57) ABSTRACT

A cosmetic applicator includes a stem, an applicator member disposed at a first end of the stem and a handle member disposed at a second end of the stem, the second end being situated opposite from the first end; the stem includes a flexible portion having shape memory, and a bottom half that is substantially inflexible.

46 Claims, 3 Drawing Sheets

APPLICATOR FOR COSMETIC PRODUCTS

CROSS-REFERENCE TO RELATED APPLICATIONS

This application claims the benefit of French Application No. 03 09604 filed on Aug. 4, 2003 and U.S. Provisional Application No. 60/499,354 filed on Sep. 3, 2003, the entire disclosures of which are incorporated by reference herein.

BACKGROUND OF THE INVENTION

The present invention relates to an applicator for a cosmetic, such as a care product (e.g., nail varnish). The present invention also relates to a packaging and applicator device including an applicator according to the present invention.

Numerous applicators include an applicator member comprising a bundle of bristles fixed to the end of a stem for the purpose of applying a substance on a surface of the human body, for example skin or keratinous fibers.

FR-A-2 722 380 and FR-A-2 722 381 disclose applicators in which a stem provides flexibility similar to that of an applicator member, the diameter of the stem over a large portion of its length being smaller than the diameter of the remainder of the stem.

The flexibility of a stem can degrade the accuracy with which makeup is applied under certain conditions of application.

FR 2 705 876 discloses a stem carrying an applicator member and including a constricted portion which is positioned level with a flocked wiper during storage. The presence of the constriction serves to prevent the stem flattening the flocking of the wiper. That stem is not designed to deform during application.

U.S. Pat. No. 2,173,959 discloses an applicator comprising a stem having one end secured in a handle member by means of a compressible sleeve. The stem remains entirely rectilinear when its orientation relative to the handle member changes.

SUMMARY OF THE INVENTION

There exists a need for an applicator enabling makeup to be applied accurately while also being comfortable to use.

In various exemplary embodiments, the present invention provides a cosmetic applicator comprising a stem, an applicator member disposed at a first end of the stem and a handle member disposed at a second end of the stem, the second end being situated opposite from the first end. In various exemplary embodiments, the stem can comprise a flexible portion having shape memory and a bottom half that is substantially inflexible.

"Bottom half" refers to the part of a stem extending between its first end connected to an applicator member and the middle of the stem. The middle of the stem is equidistant from the first end and the second end, along the stem.

Exemplary embodiments of the present invention enable application to be more accurate while imparting flexibility to the applicator.

In various exemplary embodiments, during application, when a stem begins to bend in a plane, essentially because of deformation of the flexible portion having shape memory, the stem has little tendency to deform away from the plane as the angle made between the two stem portions on either side of the flexible portion increases. This contributes to imparting accuracy to the applicator. In exemplary embodiments, the presence of a flexible portion also allows a user to change an angle between an applicator member and a surface on which a substance is being applied, since this change can be performed without significantly changing the orientation of a handle member.

In various exemplary embodiments, a distance measured along an axis of a stem between the middle of a flexible portion and a first end of the stem is longer than a distance between the middle of a flexible portion and a second end of the stem.

"Having shape memory" should be understood broadly, and refers to, for example, the case where a flexible portion, after being deformed, returns elastically to a position which is not absolutely identical to its initial position, given a material used and a shape of the flexible portion, for example.

In various exemplary embodiments, a stem comprises a distal portion extending from a first end and a proximal portion extending from a second end, the proximal and distal portions being connected by a flexible portion.

In various exemplary embodiments, a length of a proximal portion may be shorter than a length of a distal portion.

In various exemplary embodiments, a flexible portion may deform during application so as to allow a distal portion to be substantially inclined relative to a proximal portion.

In various exemplary embodiments, applicators according to this invention may enable substances to be applied accurately on a nail, while nevertheless being soft because of the presence of a flexible portion.

In various exemplary embodiments, the fact that a flexible portion is closer to a second end of a stem than to a first end can allow, where appropriate, for a distal portion to have a length that is sufficient to allow flow of a substance along the stem towards an applicator member to be undisturbed by the flexible portion while the applicator is being withdrawn from a receptacle containing the substance.

In various exemplary embodiments, positioning of a flexible portion can also enable a distal portion of a stem to be arranged in such a manner as to channel flow of a substance towards a predefined region of an applicator member. For example, such flow may be channeled by forming one or more grooves in the stem parallel to a longitudinal axis of the stem. Exemplary grooves may open out, halfway across the applicator member.

In various exemplary embodiments, softness obtained by applying a substance with applicators according to this invention reduces risk of streaks being formed and risk of disturbing equilibrium between ingredients of the substance. This reduction can result in quicker drying and allow, where appropriate, for a user to apply a second layer of substance without having to wait for a first layer to finish drying.

In various exemplary embodiments, materials forming distal and proximal portions and shapes thereof may be selected in such a manner that the distal and proximal portions do not substantially deform during application.

In various exemplary embodiments, each of distal and proximal portions may be substantially rectilinear during application.

In various exemplary embodiments, a distal portion may have a length longer than that of a proximal portion by a factor of, for example, 1.5, 1.7, 2, or more.

In various exemplary embodiments, a flexible portion may be configured in such a manner that a distal portion of a stem can be inclined reversibly during application through, for example, more than 30°, more than 45°, or even 60°, relative to an initial position in which the distal portion and a proximal portion are substantially in alignment.

In various exemplary embodiments, a length of a flexible portion may be shorter than a length of at least one of a distal portion and a proximal portion. For example, a flexible portion may extend over less than one-third or less than one-fourth of a total length of a stem.

In various exemplary embodiments, a cross-section of a flexible portion of a stem may have a major dimension of from 0.2 mm to 1.5 mm or from 0.5 mm to 0.8 mm.

In various exemplary embodiments, a flexible portion of a stem may be circularly symmetrical. For example, a flexible portion of a stem may be hourglass-shaped.

In various exemplary embodiments, a flexible portion of a stem may not be circularly symmetrical. Forming a flexible portion of a stem that is not circularly symmetrical can make it possible to obtain stem rigidity that varies depending on a direction in which a distal portion is inclined away from its initial position while applying a substance. For example, a flexible portion of a stem may have a cross-section that is generally elongate in shape.

In various exemplary embodiments, a handle member may be of a shape that is not circularly symmetrical so as to encourage gripping an applicator in a predefined orientation. In various exemplary embodiments, a handle member may include at least one finger-receiving zone. For example, a finger-receiving zone may include a flat or indented portion extending generally substantially parallel to an axis of a largest dimension of a cross-section of a flexible portion.

In various exemplary embodiments, a flexible portion may include at least one opening. For example, a flexible portion may include at least one opening disposed between two bridges of material interconnecting distal and proximal portions of a stem.

In various exemplary embodiments, a cross-section of a stem (e.g., in a distal portion) may have a shape selected from: circular, non-circular in particular oblong, oval, elliptical, polygonal (e.g., square), rectangular, kidney-shaped, crenellated and star-shaped. In various exemplary embodiments, a cross-section of a stem may have a shape including one or more grooves.

In various exemplary embodiments, a flexible portion may be made of the same material as the remainder of a stem.

In various exemplary embodiments, a flexible portion and at least one of a distal portion and a proximal portion may also be made of different materials. In various exemplary embodiments, at least one of a proximal, a distal and a flexible portion of a stem may be made of a thermoplastic material. For example, at least one of a proximal, a distal and a flexible portion of a stem may be of one or more materials selected from the group consisting of: polyethylene (PE), polypropylene (PP), polyacetal (POM), polyamine (PA), polyethylene terephthalate (PET) and polybutaline terephthalate (PBT).

In various exemplary embodiments, an applicator member may comprise at least one of the following elements: a bundle of bristles, felt, a coating of flocking and foam.

In various exemplary embodiments, when an applicator member comprises a bundle of bristles, at least two bristles of the bundle may each have at least one periodic pattern including at least one undulation, at least two periodic patterns being different. The term "periodic pattern" refers to a portion of a bristle that is reproduced substantially periodically along a length of the bristle.

In various exemplary embodiments, a bundle of bristles may include at least two bristles of different lengths or of different diameters.

In various exemplary embodiments, bristles may be made of plastic materials such as thermoplastic materials including, for example, a thermoplastic elastomer. In various exemplary embodiments, at least one bristle may be made of natural fiber.

In various exemplary embodiments, bristles may have a cross-section that is solid or hollow, circular or otherwise, with cross-sections that are constant or otherwise along the bristles. For example, bristles may include sections of larger diameter and sections of smaller diameter along their length. In various exemplary embodiments, bristles may include a coating of flocking.

In various exemplary embodiments, bristles may include a filler over all of their length, or over only part of their length. For example, bristles may include a filler comprising one or more of a magnetic compound, a humidity-absorbing compound, a compound for imparting roughness to the surface of the bristle and a compound for improving sliding. In various exemplary embodiments, a filler may be distributed in such a manner as to create a periodic pattern.

In various exemplary embodiments, a bundle of bristles may be held in a housing formed at a first end of a stem. In various exemplary embodiments, bristles may be secured in or to a housing by adhesive, stapling and/or overmolding in a housing. In various exemplary embodiments, a cross-section of a housing may be oblong, being elongate along a long axis.

In various exemplary embodiments, a housing may have a cross-section that tapers going toward an end wall, with an amount of tapering that is provided depending on a divergence that is desired for bristles. In various exemplary embodiments, an end wall of a housing may include a setback in which bristles are secured and which opens out into a portion of the housing that flares towards its opening, the flared portion allowing bristles to spread apart from one another in order to impart an enlarged shape to a bundle.

For example, a housing may be arranged in such a manner that bristles extend outside the housing over a distance measured parallel to a long axis that is greater than a size of a stem along the axis in a vicinity of the housing.

In various exemplary embodiments, applicator members may also comprise flocked tips.

In various exemplary embodiments, a stem and an applicator member may be made as a single piece by, for example, injection molding, dual injection or overmolding.

In various exemplary embodiments, at a second end, a stem may include a member for fastening to a handle member. For example, a stem may include an endpiece designed to be inserted as a force-fit or to be snap-fastened in a handle member. In various exemplary embodiments, an endpiece may comprise a tubular skirt with a collar at its base.

In various exemplary embodiments, a flexible portion may extend, at least in part, inside a handle member. For example, a flexible portion may extend substantially entirely inside a handle member.

In various exemplary embodiments, a flexible portion may be sufficiently flexible to allow a stem to come into contact with an edge of a handle member when the stem is inclined. In various exemplary embodiments, a handle member may include means for fastening the handle member onto a receptacle such as, for example, a screw thread.

In various exemplary embodiments, the present invention includes, independently or in combination with various features described above, a cosmetic applicator comprising: a stem comprising a first end and a second end situated opposite each other, an applicator member disposed at the first end of the stem and a handle member disposed at the second end of the stem. In various exemplary embodiments, the stem comprises, starting from a first end, a half that is substantially inflexible and, starting from a second end, a half including at least one flexible portion having shape memory.

In various exemplary embodiments, the present invention includes a cosmetic applicator comprising: a handle member that also serves as a cap for closing a receptacle, a stem having a first end fixed to the handle member and an applicator member fixed to a second end of the stem, opposite from the first end. In various exemplary embodiments, the stem includes a flexible portion with shape memory enabling a distal portion of the stem to be inclined relative to the handle member, the stem being capable of coming into contact with an edge of the handle member when the stem is inclined, the flexible portion being situated for the most part and preferably entirely inside the handle member.

In various exemplary embodiments, the invention present invention includes a packaging and applicator device for a substance, the device comprising an applicator as defined above and a receptacle containing the substance to be applied.

In various exemplary embodiments, a substance may be a substance including, but not limited to, a substance for application to nails, such as a nail varnish or a care product, an eyeliner or an eye shadow or a substance for application to the lips.

In various exemplary embodiments, a handle member of an applicator may constitute a cap for closing a receptacle.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Figure 1:
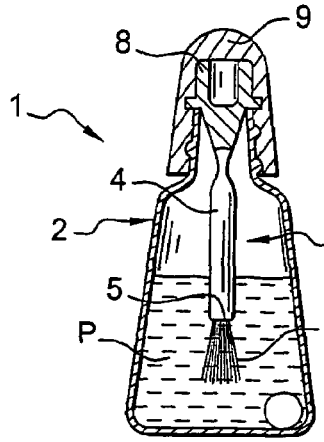
FIG. 1 is a diagrammatic axial section view of an exemplary device for applying a substance to nails.

FIG. 1 shows a packaging and applicator device 1 comprising a receptacle 2 containing a substance P for application (e.g., a nail varnish) and an applicator 3 comprising a stem 4 extended at a first end 5 by an applicator member 6 and engaged at a second end 8 in a handle member 9 which, in the embodiment shown in FIG. 1, also constitutes a cap for closing the receptacle 2.

Figure 2:
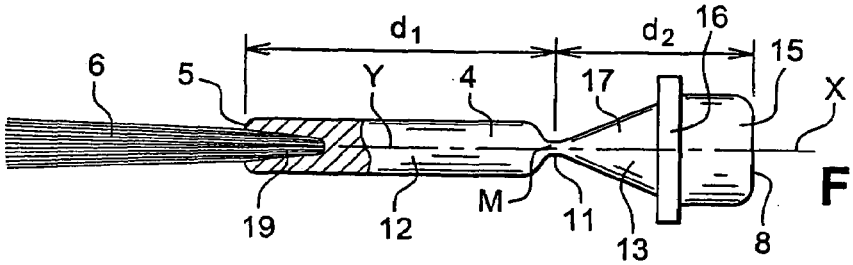
FIG. 2 is a diagrammatic fragmentary axial section view showing the stem and the applicator member of the FIG. 1 device.

The stem 4 of the applicator 3 is shown on its own in FIG. 2.

In various exemplary embodiments, the stem 4 comprises a flexible portion 11 having shape memory, interconnecting a distal portion 12 which extends between the first end 5 and the flexible portion 11 and a proximal portion 13 which extends between the second end 8 and the flexible portion 11.

The distance $d_1$ measured between the middle M of the flexible portion and the first end 5 is longer than the distance $d_2$ measured between said middle point M and the second end 8.

By way of example, the ratio $d_1/d_2$ can be at least 1, at least 1.2, at least 1.5, or even 2.

The stem 4 can be fastened in the handle member 9 in various ways.

In the exemplary embodiment shown in FIG. 1, the proximal portion 13 includes an endpiece comprising a cylindrical skirt 15 provided at its base with a collar 16, which collar snaps into corresponding relief in the inside surface of the handle member 9, as can be seen in particular in FIG. 1. The collar 16 may also serve to provide leak-tight closure of the receptacle 2.

The proximal portion 13 also includes a tapering portion 17 that tapers towards the flexible portion 11 in this embodiment.

Naturally, the stem 4 could be fastened in some other way to the handle member 9. For example, the stem 4 could be made integrally with the handle member 9 or the stem 4 could be secured to the handle member 9 by adhesive, by heat-sealing, as a force-fit, or by means of a fastener element fitted to the handle member 9 and/or to the stem 4.

The inside of the handle member 9 may be provided with a thread 18 enabling it to be screwed onto a threaded neck of the receptacle 2.

In the embodiment shown in FIG. 1, the applicator member 6 is constituted by a bundle of bristles received at one end in a housing 19 of the distal portion 12. The bundle of bristles may, in particular, be fixed in the housing 19 by means of a staple or by any other appropriate means. For example, the bundle of bristles may, in particular, be fixed by means of an adhesive, heat-sealing or stamping into the stem.

In the embodiment shown in FIG. 2, the flexible portion 11 presents a cross-section that is circular, and is made as a single piece with the remainder of the stem 4 by molding a plastic material.

Naturally, and as described below, the flexible portion 11 can be made to have a cross-section that is not circularly symmetrical, and, where appropriate, it can also be made out of a material that is different from that of the proximal and distal portions.

By way of example, the stem 4 can be made out of one or more thermoplastic materials including, but not limited to, polyolefins (e.g., polyethylene or polypropylene) or other plastic materials such as, for example, POM, PA, PET, or PBT.

Figure 3:
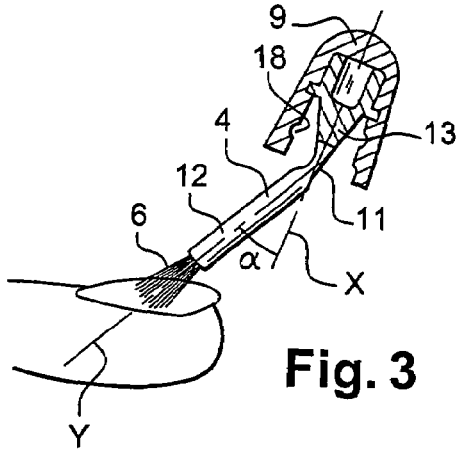
FIG. 3 is a diagrammatic fragmentary axial section view showing the applicator of the FIG. 1 device in use.

When in use, the flexible portion 11 can deform so that the distal portion 12 is inclined relative to the proximal portion 13, as shown in FIG. 3. This can make it possible to obtain application that is more gentle.

It may be observed on examining FIG. 3 that the distal portion 12 conserves a shape that is substantially rectilinear during application, and so does the proximal portion 13.

While in use, the angle $\alpha$ between the longitudinal axis X of the proximal portion 13 and the longitudinal axis Y of the distal portion 12 can reach an angle of, for example, 30° or more relative to an initial position in which the angle $\alpha$ is substantially zero and the axes X and Y substantially coincide.

When a user ceases to apply the applicator member 6 onto the surface to be treated, the flexible portion 11 tends, because of its shape memory, to return the distal portion 12 substantially into alignment with the proximal portion 13, with the axes X and Y substantially coinciding once the applicator has been put back into the receptacle 2, as shown in FIG. 3.

Naturally, it would not go beyond the ambit of the present invention when at least one of the proximal portion and the distal portion extends along a longitudinal axis that is not rectilinear or the angle $\alpha$ is not zero when the applicator is in place in the receptacle.

The flexible portion 11 and the proximal and distal portions 13 and 12 can be made with still other shapes without thereby going beyond the ambit of the present invention.

Figure 4:
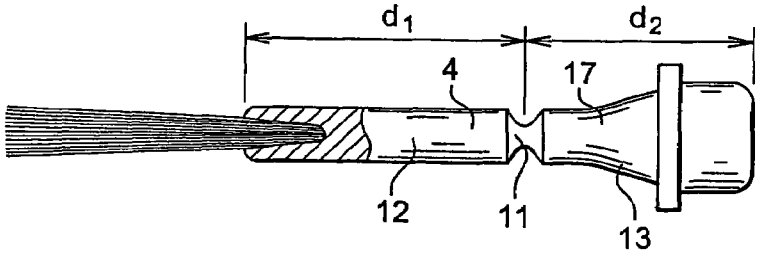
FIGS. 4 and 5 are diagrammatic fragmentary axial section views showing two exemplary embodiments of a stem.

By way of example, FIG. 4 shows a stem 4 in which the flexible portion 11 is generally hourglass-shaped.

The flexible portion 11 may be symmetrical in shape about a transverse plane passing through its middle M, as is the case for the example of FIG. 4, however it would not go beyond the ambit of the present invention when that is not the case, for example when the flexible portion 11 does not present any symmetry about any plane perpendicular to the longitudinal axis of the stem 4.

The length of the flexible portion 11 may be greater or smaller than shown in FIG. 4. For example, the stem 4 shown in FIG. 5 has a flexible portion 11 of length that is greater than in stem 4 shown in FIG. 4.

Figure 5:
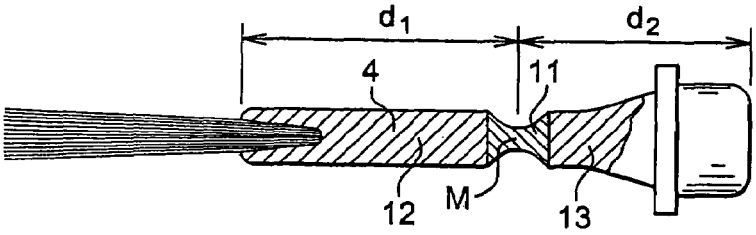

In addition, in the embodiment shown in FIG. 5, the flexible portion 11 is made of a material other than the material from which the distal and proximal portions 12 and 13 are made.

In various exemplary embodiments, the flexible portion 11 can be made by dual injection of material together with the distal and proximal portions 12 and 13.

For example, the flexible portion 11 can be made out of an elastomer material while the distal and proximal portions 12 and 13 are made of a relatively rigid, non-elastomer plastic material.

Figure 6:
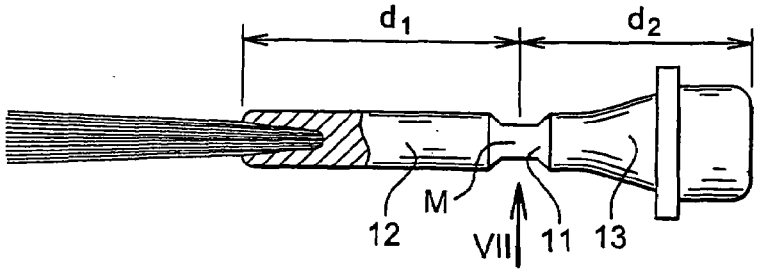
FIGS. 6 and 7 are views in two perpendicular directions showing exemplary embodiments of a stem.
Figure 7:
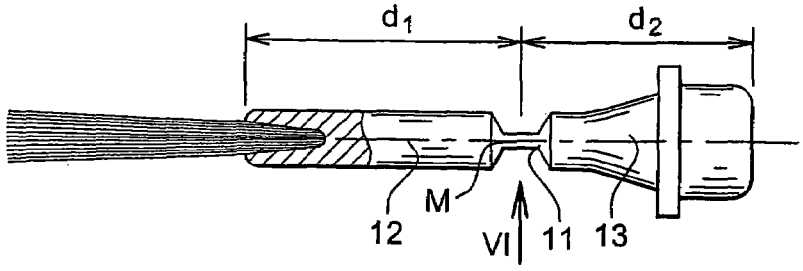

The flexible portion 11 may be made to have a cross-section that is not circularly symmetrical about the longitudinal axis of the stem and, for example, may have a cross-section that is flattened, as shown in FIGS. 6 and 7.

Such a cross-section allows a stem to be more deformable in a first plane than it is in a second plane perpendicular to the first, the first plane coinciding with the section plane as shown, for example, in FIG. 7.

For example, the stem 4 may have a cross-section in a section plane passing through the middle M that is substantially rectangular in shape, the stem being capable of deforming in preferred manner in a plane perpendicular to the long side of the rectangle.

The distal portion 12 may be made with at least one groove 20 in its outside surface, the groove being in the form of longitudinal fluting extending parallel to the longitudinal axis Y of the distal portion 12, for example. Such a groove 20 can serve, for example, to channel a substance flowing under gravity along the stem towards the applicator member 6 after the applicator has been withdrawn from the receptacle, so that it flows towards predefined zones of the applicator member 6.

Figure 8:
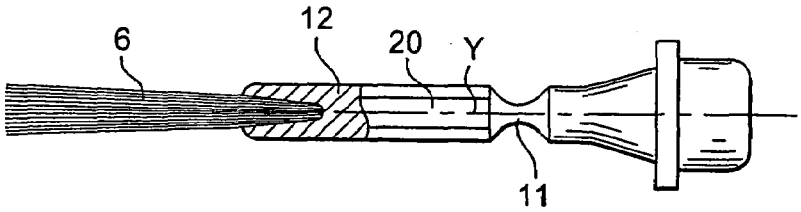
FIGS. 8 and 9 are diagrammatic fragmentary axial section views showing two exemplary embodiments of a stem.
Figure 9:
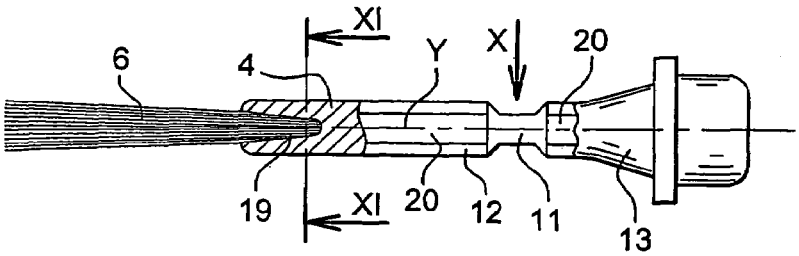
Figure 10:
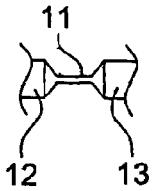
FIG. 10 is a side view seen along arrow X in FIG. 9.

In the embodiment shown in FIG. 8, the flexible portion 11 has a cross-section that is circularly symmetrical, but as mentioned above, the flexible portion may also be made to have a cross-section that is not circularly symmetrical, as is also the case in the embodiments shown in FIGS. 9 and 10.

As shown in FIG. 9, the groove 20 may be extended over the proximal portion 13.

Figure 11:
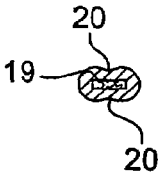
FIG. 11 is a cross-section on XI-XI of FIG. 9.

The housing 19 receiving the bundle of bristles may be of a shape that is not circularly symmetrical about the axis Y of the distal portion 12, as shown in FIG. 11. The groove 20 may be arranged to bring the substance substantially to the middle of the long side of the housing 19, as shown in FIG. 11.

FIG. 11 also shows that the stem 4 can have two grooves 20, one opposite the other.

In various exemplary embodiments, when the flexible portion 11 is made to have a cross-section that is not circularly symmetrical, thus giving the stem 4 at least one preferred direction of deformation, the handle member may be made with a shape that leads the user to take hold of it in a predetermined manner, associated with the orientation of the cross-section of the flexible portion 11.

Figure 12:
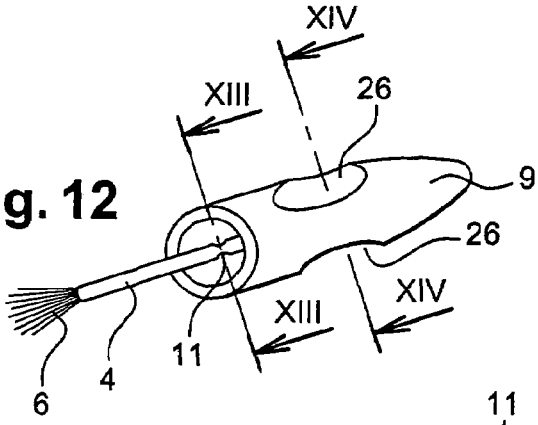
FIG. 12 is a diagrammatic view of an exemplary embodiment of an applicator.

In various exemplary embodiments, the handle member may have recesses 26 or flats on two opposite sides serving to receive the fingers of the user, as shown in FIG. 12.

Figure 14:
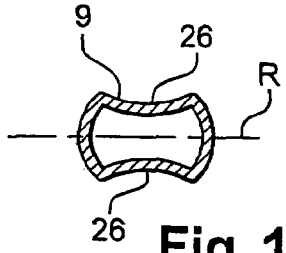
FIG. 14 is a diagrammatic and fragmentary cross-section of the FIG. 12 handle member on XIV-XIV.
Figure 13:
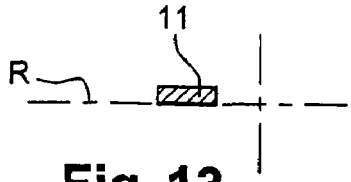
FIG. 13 is a diagrammatic cross-section of the FIG. 12 stem on XIII-XIII.

By comparing FIGS. 13 and 14, it can be seen that the flexible portion 11 and the handle member can have shapes that are generally flat in a common plane R, the stem 4 deforming in preferred manner in a plane perpendicular to the plane R.

Figure 15:
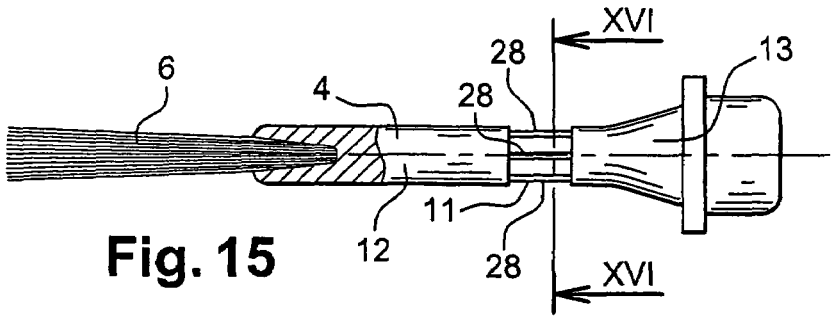
FIG. 15 shows an exemplary embodiment of a stem.
Figure 16:
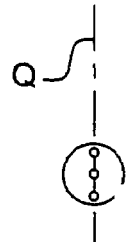
FIG. 16 is a cross-section on XVI-XVI in FIG. 15.

The flexible portion 11 can be made with at least one opening, as shown in FIGS. 15 and 16. In this embodiment, the flexible portion 11 comprises three bridges of material 28 interconnecting the distal and proximal portions 12 and 13, the bridges extending parallel to one another and lying in a common plane Q containing the longitudinal axis of the stem 4, and also constituting a plane of symmetry for the stem, in the example shown.

The bridges of material 28 enable the stem 4 to bend more easily about an axis parallel to the plane Q than about an axis perpendicular thereto.

The bridges of material 28 may be made of the same material as the distal and proximal portions 12 and 13, or out of a different material.

The distal portion 12 may be made with a variety of cross-sections in the housing 19 that is to receive the bundle of bristles 6.

FIGS. 17 to 23 show various exemplary embodiments of cross-sections.

Figure 17:
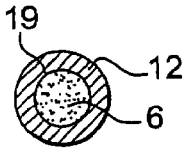
FIGS. 17 to 23 are cross-sections of exemplary stems at an applicator member.
Figure 18:
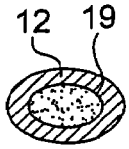

A cross-section may be, for example, circular, as shown in FIG. 17, oblong (e.g., oval or elliptical), as shown in FIG.

Figure 19:
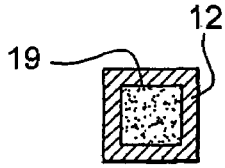
Figure 20:
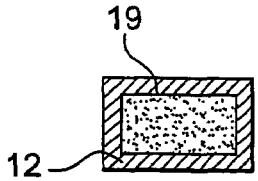
Figure 21:
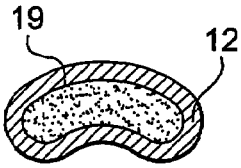
Figure 22:
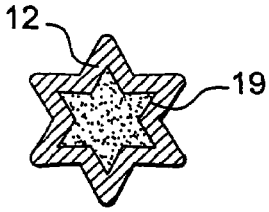
Figure 23:
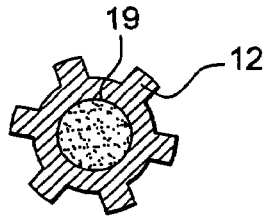

18, polygonal (e.g., square or rectangular), as shown in FIGS. 19 and 20, kidney-shaped, as shown in FIG. 21, star-shaped, as shown in FIG. 22, or crenellated, as shown in FIG. 23.

Figure 24:
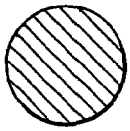
FIGS. 24 to 30 are diagrams showing exemplary cross-sections of bristles that can be used to make an applicator member.
Figure 25:
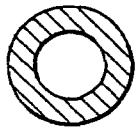
Figure 26:
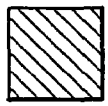
Figure 27:
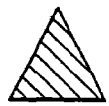
Figure 28:
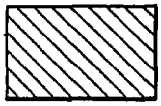
Figure 29:
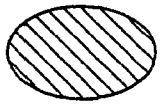
Figure 30:
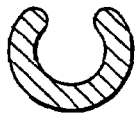

Bristles on the bundle 6 may be of a very wide variety of kinds, and, for example, it is possible to use bristles having any one of the cross-sections shown in FIGS. 24 to 30. Such exemplary cross-sections include, but are not limited to, a solid cross-section of circular outline, as shown in FIG. 24, a hollow cross-section (e.g., of circular outline), as shown in FIG. 25, a cross-section that is polygonal (e.g., square), as shown in FIG. 26, triangular, as shown in FIG. 27, rectangular, as shown in FIG. 28, or oblong (e.g., elliptical), as shown in FIG. 29. Bristles may also include at least one capillary groove, as shown in FIG. 30.

The bundle 6 may comprise a mixture of bristles, including multiple cross-sections, such as described above.

Figure 31:
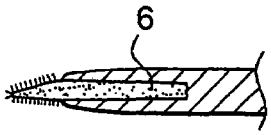
FIG. 31 is a diagrammatic and fragmentary longitudinal section view showing an exemplary embodiment of an applicator member.

Naturally, the invention is not limited to an applicator member constituted by a bundle of bristles, for example, the applicator member may be constituted by a flocked tip, as shown in FIG. 31. Such a flocked tip may be for applying substance onto, for example, skin, mucous membranes, nails or hair.

It is also possible for the applicator member 6 to be constituted by any other conventional applicator member, such as, for example, foam, a brush, felt, a capillarity applicator, possibly made integrally with the distal portion 12 or else fitted thereto, depending on the nature of the substance and the surface to be treated.

The invention is not limited to the embodiments described above, and in particular it is possible to combine the characteristics of the various embodiments with one another.

In various exemplary embodiments, the stem is made having a single flexible portion. Nevertheless, without going beyond the ambit of the present invention, the stem could also be made with more than one flexible portion. For example, the stem could include at least two flexible portions situated at different positions along its length and interconnected by a portion that is substantially inflexible.

While this invention has been described in conjunction with the exemplary embodiments and examples outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. A device for packaging and applying a cosmetic substance, the device comprising:

a receptacle containing the substance, an applicator configured to close the receptacle and comprising:

a stem;

an applicator member disposed at a first end of the stem; and a handle member disposed at a second end of the stem, the second end being situated opposite from the first end;

wherein the stem comprises a distal portion having a length, a flexible portion having shape memory and proximal to the distal portion, the stem having a bottom half that is substantially inflexible, and the flexible portion allowing the distal portion to be reversibly tilted during application through an angle of more than 30° relative to an initial position.

2. The device of claim 1, wherein the distal portion extends from the first end and wherein the stem comprises a proximal portion having a length and extending from the second end, the length of the proximal portion being shorter than the length of the distal portion, the distal and proximal portions being interconnected by the flexible portion.

3. The device of claim 2, wherein the length of the distal portion is longer than the length of the proximal portion by a factor of 1.5.

4. The device of claim 2, wherein the length of the distal portion is longer than the length of the proximal portion by a factor of 1.7.

5. The device of claim 2, wherein the length of the distal portion is longer than the length of the proximal portion by a factor of at least 2.

6. The device of claim 2, wherein each of the distal and proximal portions is substantially rectilinear during application.

7. The device of claim 2, wherein the flexible portion is configured such that the distal portion of the stem can be reversibly tilted during application through an angle of more than 45° relative to an initial position in which the distal portion and the proximal portion are substantially in alignment.

8. The device of claim 2, wherein the flexible portion is configured in such a manner that the distal portion of the stem can be reversibly tilted during application through an angle of 60° relative to an initial position in which the distal portion and the proximal portion are substantially in alignment.

9. The device of claim 1, wherein in the initial position, the distal portion and the proximal portion are substantially in alignment.

10. The device of claim 1, wherein the flexible portion has a length that is shorter than the length of at least one of the distal and proximal portions.

11. The device of claim 1, wherein the flexible portion extends over less than one-third of a total length of the stem.

12. The device of claim 1, wherein the flexible portion extends over less than one-fourth of a total length of the stem.

13. The device of claim 1, wherein a cross-section of the flexible portion of the stem has a major dimension of from 0.2 mm to 1.5 mm in length.

14. The device of claim 1, wherein a cross-section of the flexible portion of the stem has a major dimension of from 0.5 mm to 0.8 mm in length.

15. The device of claim 1, wherein the flexible portion of the stem is circularly symmetrical.

16. The device of claim 1, wherein the flexible portion of the stem is not circularly symmetrical.

17. The device of claim 16, wherein a cross-section of the flexible portion of the stem is generally elongate in shape.

18. The device of claim 1, wherein the handle member is not circularly symmetrical in shape, encouraging the applicator to be held with a predefined orientation.

19. The device of claim 18, wherein the handle member includes at least one finger-receiving zone that extends substantially parallel to a major axis of a cross-section of the flexible portion.

20. The device of claim 19, wherein the finger-receiving zone is a flat or an indentation.

21. The device of claim 1, wherein the flexible portion includes at least one opening.

22. The device of claim 21, wherein the at least one opening is disposed between two bridges of material interconnecting the distal and proximal portions of the stem.

23. The device of claim 1, wherein a cross-section of the stem has a shape selected from the group consisting of: circular, oblong, polygonal, kidney-shaped, crenellated, star-shaped, and a shape including one or more grooves.

24. The device of claim 23, wherein the oblong shape is a shape selected from the group consisting of oval and elliptical.

25. The device of claim 23, wherein the polygonal shape is a shape selected from the group consisting of square and rectangular.

26. The device of claim 1, wherein the flexible portion and at least one of the distal and proximal portions are made from different materials.

27. The device of claim 1, wherein the stem comprises a proximal portion and wherein at least one of the proximal, distal, and flexible portions of the stem is made from a thermoplastic material.

28. The device of claim 27, wherein the material is at least one material selected from the group consisting of: polyethylene (PE), polypropylene (PP), polyacetal (POM), polyamine (PA), polyethylene terephthalate (PET) and polybutaline terephthalate (PBT).

29. The device of claim 1, wherein the applicator member comprises at least one element selected from the group consisting of: a bundle of bristles, felt, a coating of flocking and foam.

30. The device of claim 1, wherein the applicator member comprises a bundle of bristles.

31. The device of claim 1, wherein the applicator member comprises a flocked tip.

32. The device of claim 1, wherein the stem comprises at its second end a member for fastening the stem to the handle member.

33. The device of claim 32, wherein the fastener member comprises an end piece for force-fit insertion into the handle member.

34. The device of claim 32, wherein the fastener member comprises an end piece for snap-fastening to the handle member.

35. The device of claim 34, wherein the end piece comprises a tubular skirt with a collar at its base.

36. The device of claim 1, wherein the handle member comprises means for fastening the handle member on a receptacle.

37. The device of claim 36, wherein the means for fastening comprises a thread.

38. The device of claim 1, wherein the flexible portion extends at least in part inside the handle member.

39. The device of claim 1, wherein the flexible portion extends substantially entirely inside the handle member.

40. The device of claim 1, wherein the flexible stem is sufficiently flexible to enable the stem to come into contact with an edge of the handle member when the stem is inclined.

41. The device of claim 1, wherein the receptacle contains a substance for application.

42. The device of claim 1, wherein the substance is a substance for application to nails.

43. The device of claim 42, wherein the substance is a nail varnish or a care product for nails.

44. The device of claim 1, wherein the substance is an eyeliner, an eye shadow or a substance for application to lips.

45. The device of claim 44, wherein the handle member of the applicator constitutes a cap for closing the receptacle.

46. An applicator, comprising:

a stem comprising a first end and a second end opposite from the first end;

an applicator member fixed to the first end of the stem; and a handle member that also serves as a cap for closing a receptacle, the handle member being fixed to the second end of the stem;

the stem including a flexible portion with shape memory enabling a distal portion of the stem to be inclined reversibly relative to the handle member, the stem being capable of coming into contact with an edge of the handle member when the stem is inclined and the flexible portion being situated for the most part inside the handle member.

* * * * *